US008277175B2

(12) United States Patent
Garrison et al.

(10) Patent No.: US 8,277,175 B2
(45) Date of Patent: Oct. 2, 2012

(54) COMBUSTION AIR SUPPLY BLOWER WITH ACCESS COVER AND MOTOR AND FAN ASSEMBLY

(75) Inventors: Bobby D. Garrison, Cassville, MO (US); Steven W. Post, Cassville, MO (US)

(73) Assignee: RBC Horizon, Inc., Beloit, WI (US)

( * ) Notice: Subject to any disclaimer, the term of this patent is extended or adjusted under 35 U.S.C. 154(b) by 1017 days.

(21) Appl. No.: 12/060,659

(22) Filed: Apr. 1, 2008

(65) Prior Publication Data

US 2008/0247869 A1 Oct. 9, 2008

Related U.S. Application Data

(60) Provisional application No. 60/910,011, filed on Apr. 4, 2007.

(51) Int. Cl.
*F01D 25/24* (2006.01)

(52) U.S. Cl. ..... 415/126; 415/241.1; 415/213.1; 415/220; 417/423.14

(58) Field of Classification Search ..... 415/119, 415/214.1, 126, 201, 213.1, 220; 417/423.7, 417/423.14

See application file for complete search history.

(56) References Cited

U.S. PATENT DOCUMENTS

| | | | | |
|---|---|---|---|---|
| 2,425,655 | A * | 8/1947 | Tompkins | 601/57 |
| 4,672,819 | A * | 6/1987 | Mino et al. | 62/298 |
| 5,397,950 | A * | 3/1995 | Norbury et al. | 310/91 |
| 6,994,517 | B2 | 2/2006 | Gatley, Jr. et al. | |
| 7,290,980 | B2 | 11/2007 | Gatley, Jr. et al. | |

* cited by examiner

*Primary Examiner* — Edward Look
*Assistant Examiner* — Adam W Brown
(74) *Attorney, Agent, or Firm* — Thompson Coburn LLP

(57) ABSTRACT

A combustion air supply blower includes a blower housing having a housing body and housing cover. The cover is removably attached to the housing body and generally provides access to a motor and fan assembly including a fan and a motor. The motor and fan assembly is removably mounted within the housing body and is captured between the housing body and the housing cover such that, upon removal of the housing cover, the motor and fan assembly is exposed and may then be lifted out of the housing body for easy maintenance, repair, and/or replacement of any portion of the motor and fan assembly. Alternatively, upon removal of the housing cover, the motor and fan assembly may be accessed while remaining within the housing body to complete any maintenance and/or repair of the motor and fan assembly.

18 Claims, 9 Drawing Sheets

COMBUSTION AIR SUPPLY BLOWER WITH ACCESS COVER AND MOTOR AND FAN ASSEMBLY

This patent appreciation claims the benefit of provisional patent application No. 60/910,011, which was filed on Apr. 4, 2007.

BACKGROUND

1. Field of the Invention

The present invention relates to air moving devices and, in particular, to blowers of the type which are used with furnaces for drawing air from outside of a building or mobile home into the furnace to support combustion and to push combustion exhaust products outside of the building or mobile home. More particularly, the present invention relates to an access cover of the blower housing and a motor and fan assembly removably mounted therein.

2. Description of the Related Art

In smaller furnaces used in buildings and in mobile homes, for example, standard air-draw effects are not sufficient to assure the required air flow through the furnace heat exchangers, and therefore, these furnaces utilize combustion air supply blowers to provide sufficient air flow through the furnace. In particular, the blowers boost fresh air into the furnace's burners to support combustion and to move flue gases through the furnace heat exchangers and ultimately push the flue gases outwardly through exhaust piping to the exterior of the building or mobile home.

Existing blowers have blower housings which have motor and fan assemblies mounted thereto with separate brackets and/or motor and fan assemblies fixedly attached directly to a cover provided with the blower housing. These designs can potentially complicate maintenance and servicing of the motor and fan assembly.

What is needed is an apparatus which is an improvement over the foregoing.

SUMMARY

The present invention provides a combustion air supply blower including a blower housing having a housing body and housing cover. The cover is removably attached to the housing body and generally provides access to a motor and fan assembly including a fan and a motor. The motor and fan assembly is removably mounted within the housing body and is captured within the housing body and the housing cover such that, upon removal of the housing cover, the motor and fan assembly is exposed and may then be lifted out of the housing body for easy maintenance, repair, and/or replacement of any portion of the motor and fan assembly. Alternatively, upon removal of the housing cover, the motor and fan assembly may be accessed while remaining within the housing body to complete any maintenance and/or repair of the motor and fan assembly.

In one form thereof, the present invention provides a combustion air supply blower including a housing; a cover removably attached to the housing; and a motor and fan assembly, the motor and fan assembly mounted within the blower by capture of at least a portion of the motor and fan assembly between cooperating portions of the housing and the cover.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The example set out herein illustrates one embodiment of the invention and such example is not to be construed as limiting the scope of the invention in any manner.

DETAILED DESCRIPTION

Figure 1:
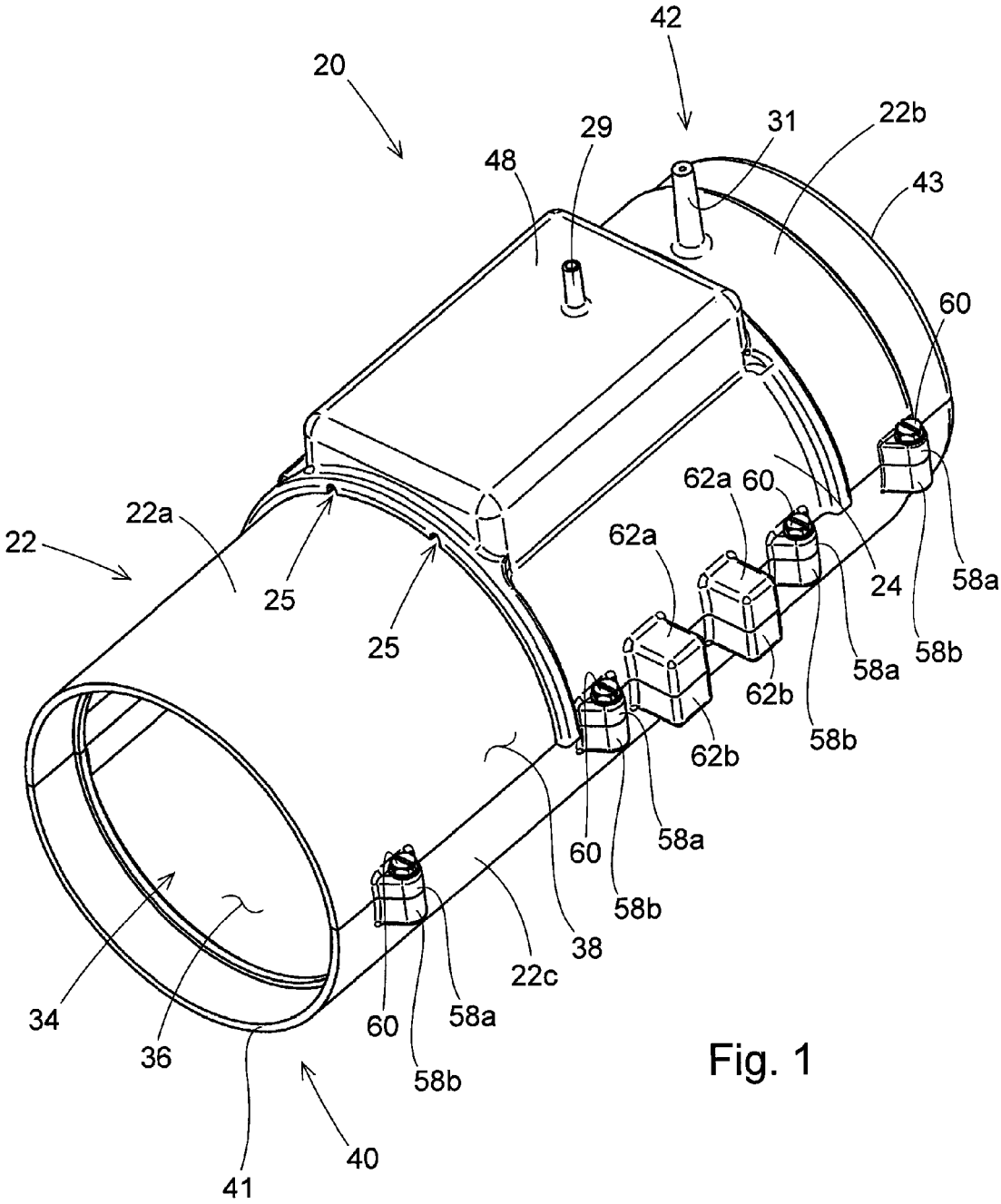
FIG. 1 is a perspective view of a blower housing in accordance with the present invention.
Figure 2:
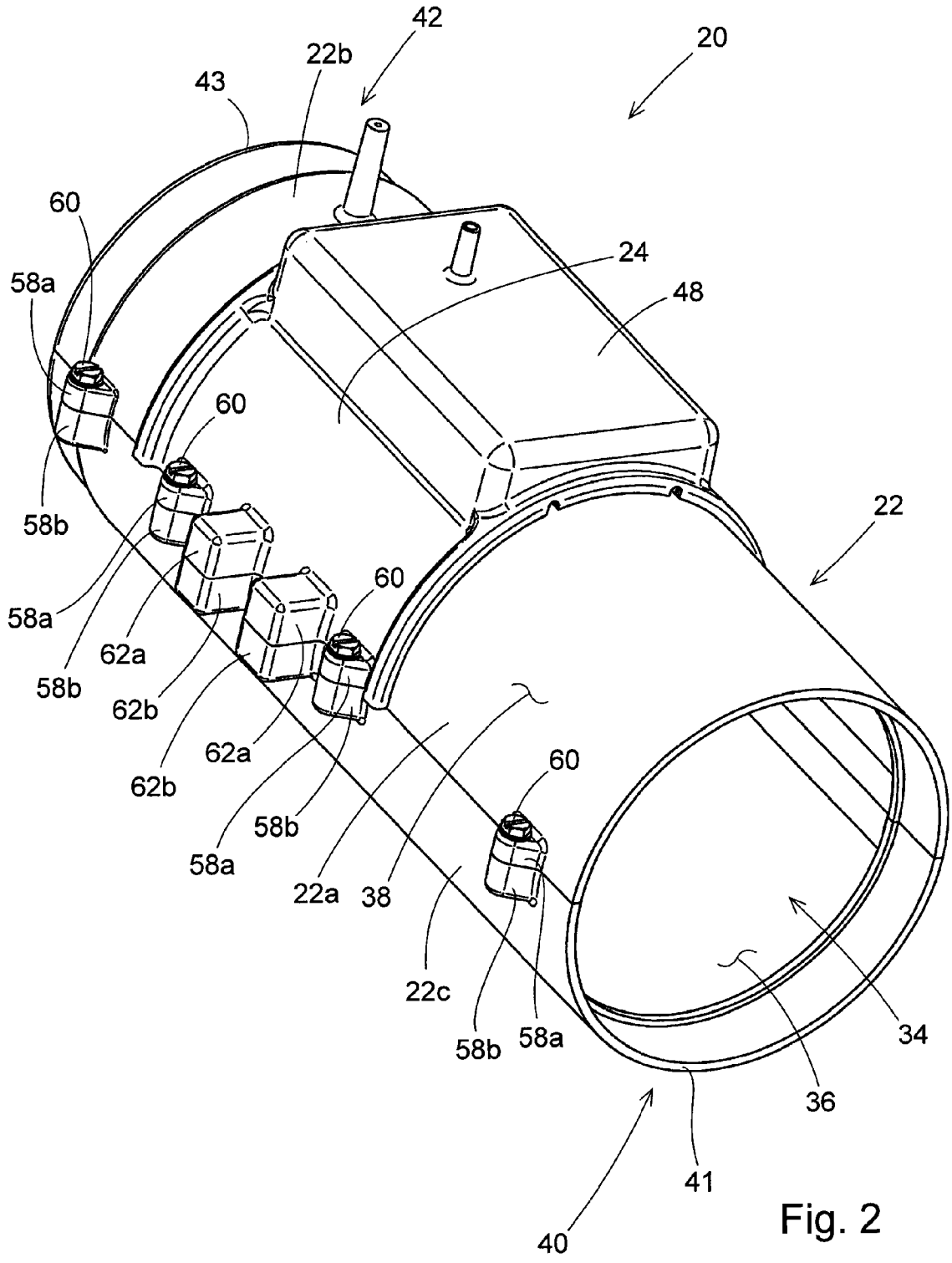
FIG. 2 is another perspective view of the blower housing of FIG. 1, viewed from an input end.

Referring to FIGS. 1 and 2, a combustion air supply blower 20 for a furnace is shown, according to the present invention. Blower 20 generally includes blower housing 22 having housing members 22*a*, 22*b*, 22*c*, and also includes cover 24. Housing 22 and cover 24 may be formed of stamped or formed metal, or may be formed of plastic via an injection molding process, for example. Suitable plastics for housing 22 and cover 24 include polypropylene or other thermoplastics. Housing 22 includes a generally cylindrical outer wall 38 and an inner wall 36 which defines a substantially hollow interior throughbore 34. Cover 24 includes a plurality of power cord apertures 25 for routing power cords (not shown) to motor and fan assembly 28 (FIGS. 5-9). Cover 24 may include pressure static tap 29 and housing member 22*b* may include pressure static tap 31. Pressure static taps 29, 31 are connected to a vacuum switch system (not shown) which prevents activation of a burner (not shown) of the furnace in the event that no airflow or insufficient airflow is present in housing 22.

Housing 22 and cover 24 additionally include a plurality of mounting lugs 58 integrally formed therewith, which are disposed radially outwardly of outer wall 38 and spaced along the longitudinal length of blower housing 22 and cover 24. Mounting lugs 58 include threaded openings or passages 50 (FIG. 5) therethrough for receipt of fasteners 60 to attach housing members 22*a*, 22*b*, 22*c* and cover 24 to each other, respectively. Fasteners 60 extend through mounting lugs 58*a*, 58*b* to attach respective portions of blower 20 together. Specifically, housing member 22*a* is attached to housing member 22*c* by aligning mounting lugs 58*a* of housing member 22*a* with mounting lugs 58*b* of housing member 22*c* and inserting fasteners 60 through openings 50 in mounting lugs 58*a*, 58*b*; housing member 22*b* is attached to housing member 22*c* by aligning mounting lugs 58*a* of housing member 22*b* with mounting lugs 58*b* of housing member 22*c* and inserting fasteners 60 through openings 50 in mounting lugs 58*a*, 58*b*; and cover 24 is attached to housing member 22*c* by aligning mounting lugs 58*a* of cover 24 with mounting lugs 58*b* of housing member 22*c* and inserting fasteners 60 through openings 50 in mounting lugs 58*a*, 58*b*.

Housing 22 includes input end 40 adapted to be operatively attached to an intake pipe (not shown) to communicate interior throughbore 34 of housing 22 with combustion air for a furnace.

Figure 3:
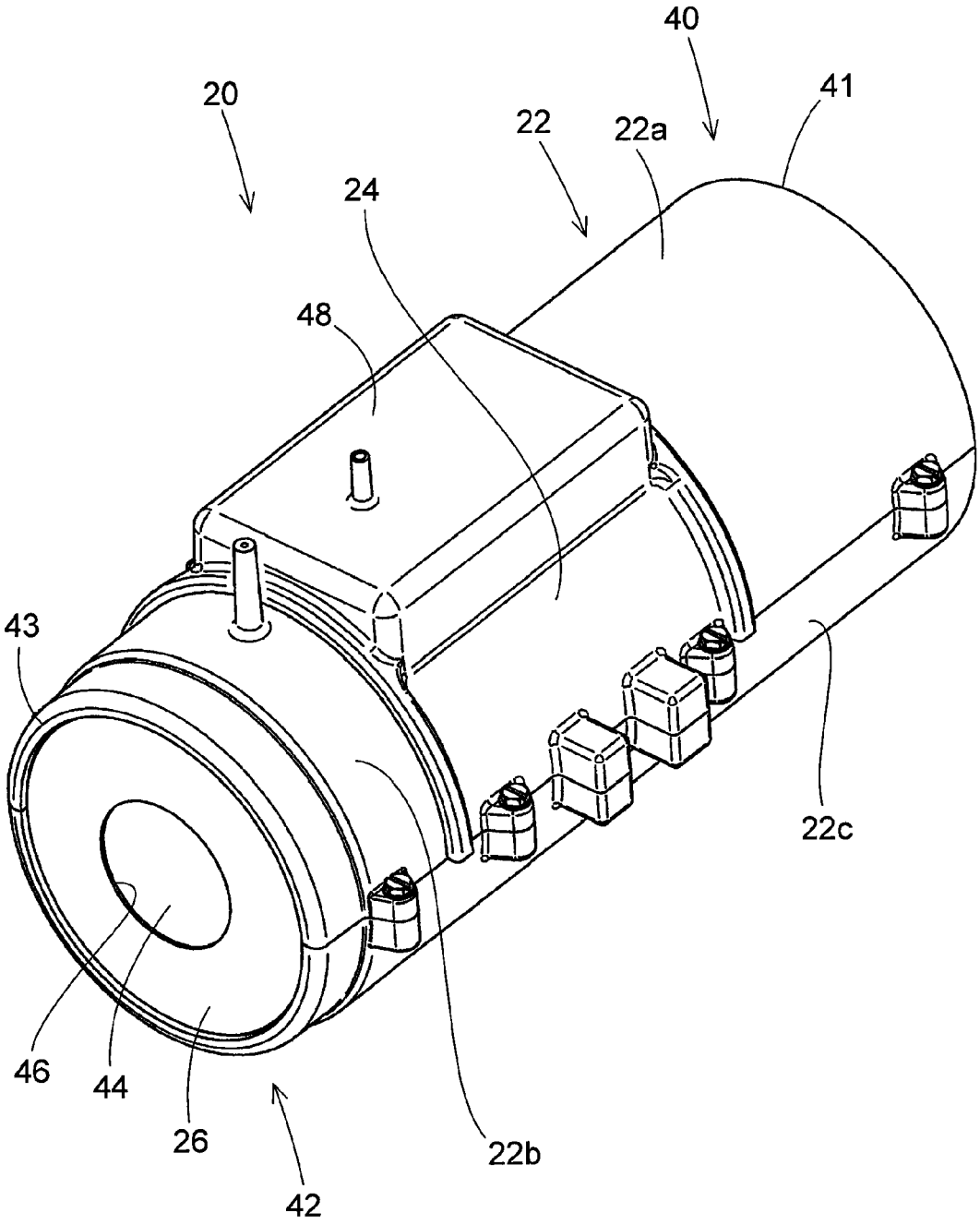
FIG. 3 is another perspective view of the blower housing of FIG. 1, viewed from an exhaust end.
Figure 4:
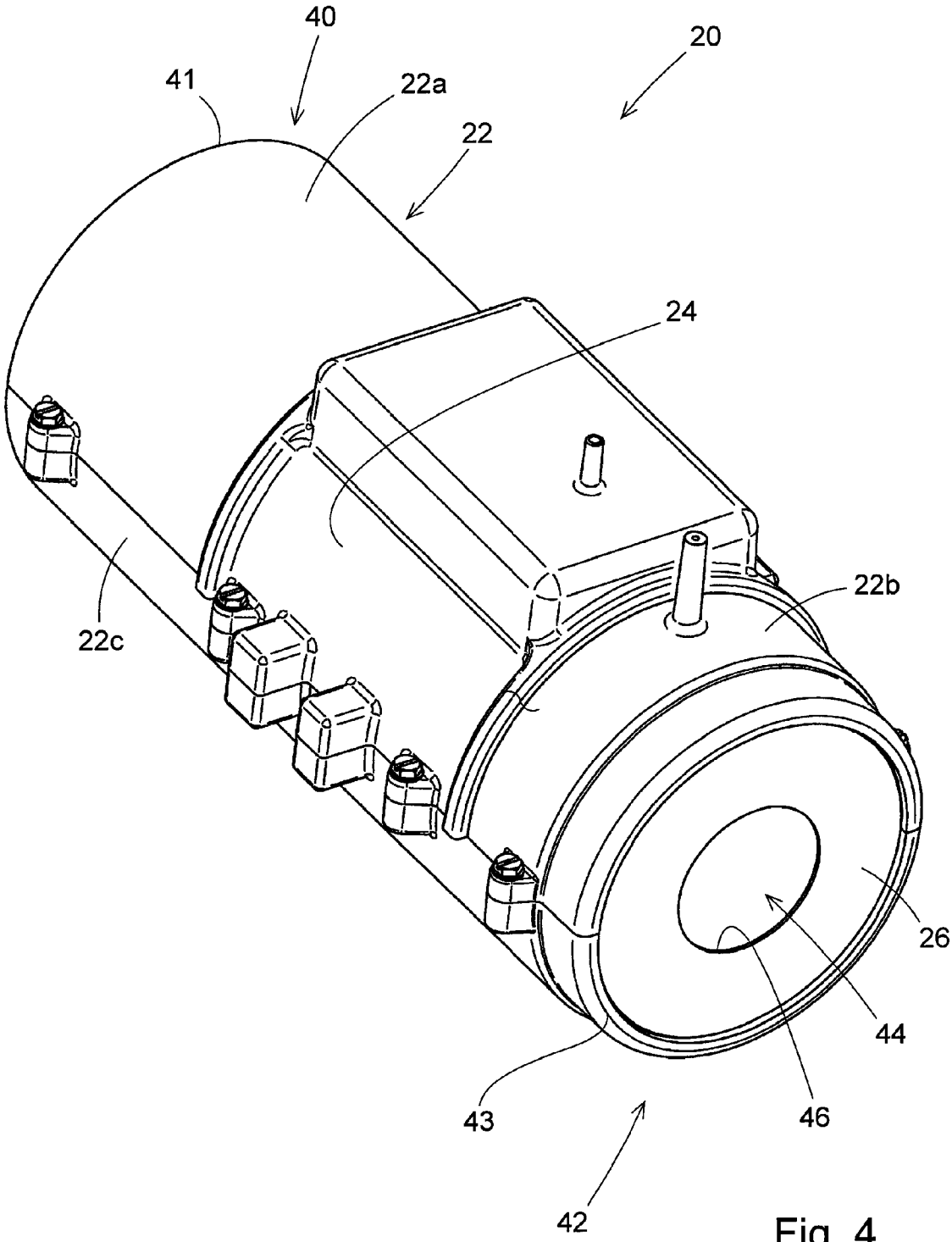
FIG. 4 is another perspective view of the blower housing of FIG. 1, viewed from the exhaust end.
Figure 5:
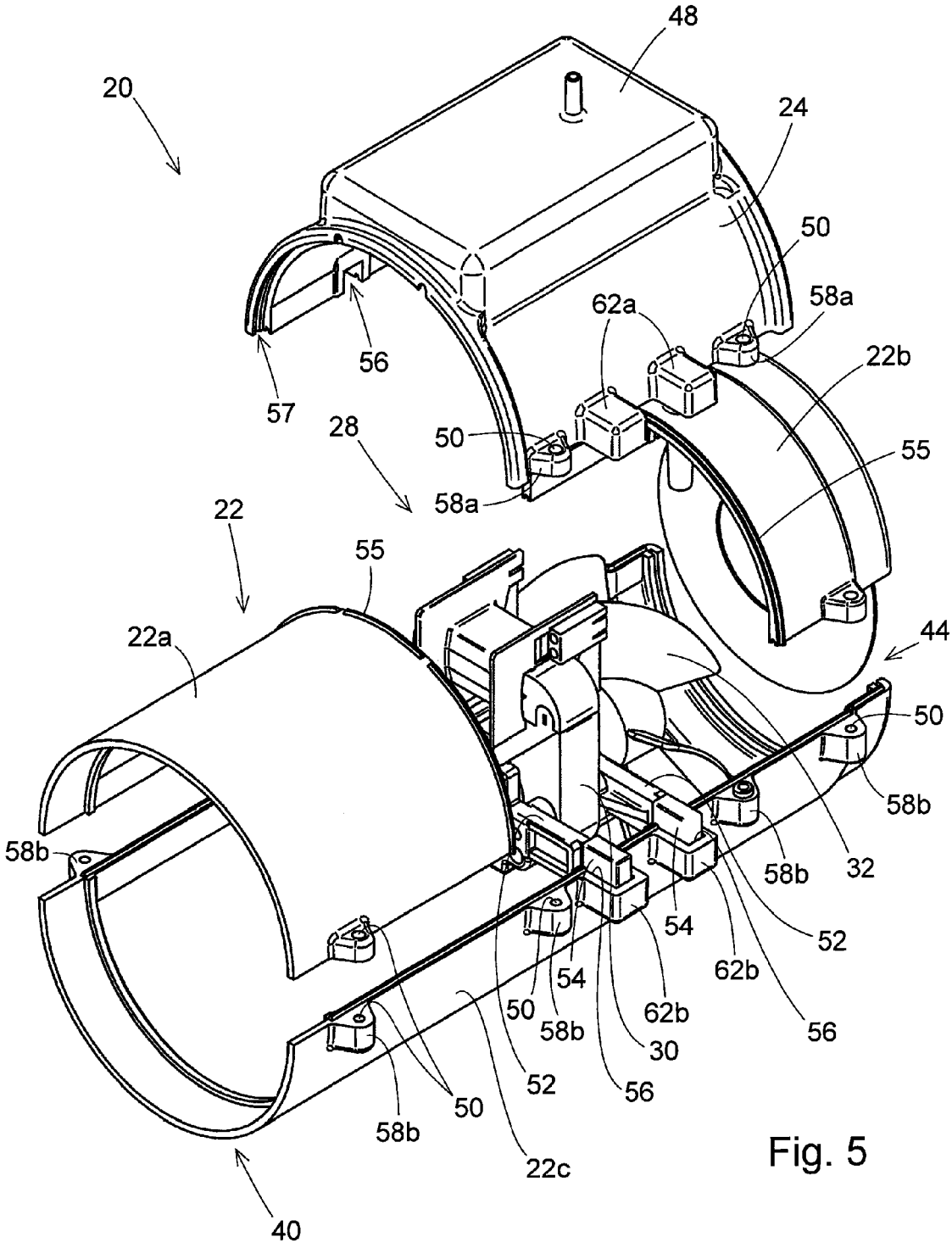
FIG. 5 is a partially exploded view of the blower housing of FIG. 1, showing the cover and the housing members exploded away from each other.
Figure 6:
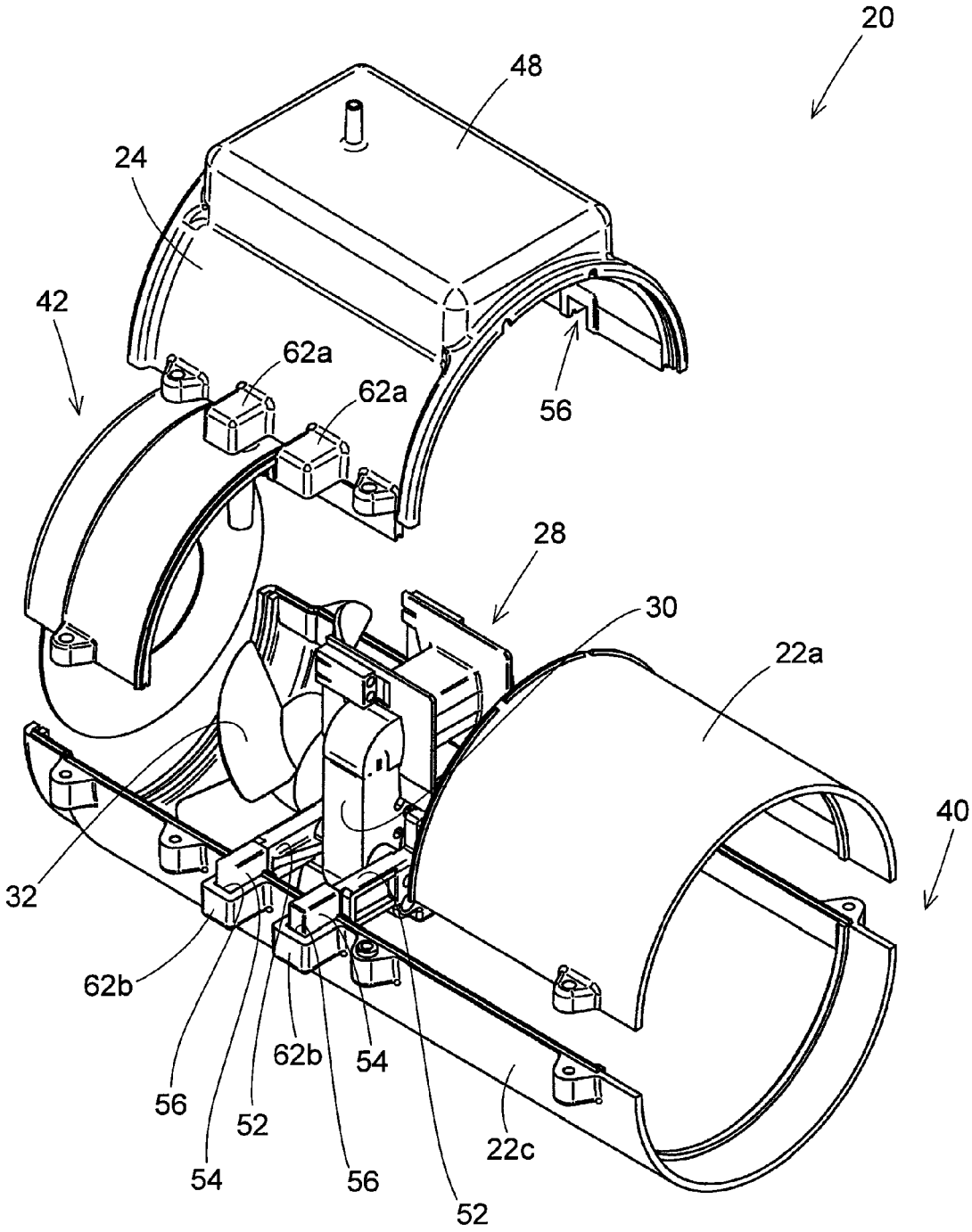
FIG. 6 is another partially exploded view of the blower housing of FIG. 1.
Figure 7:
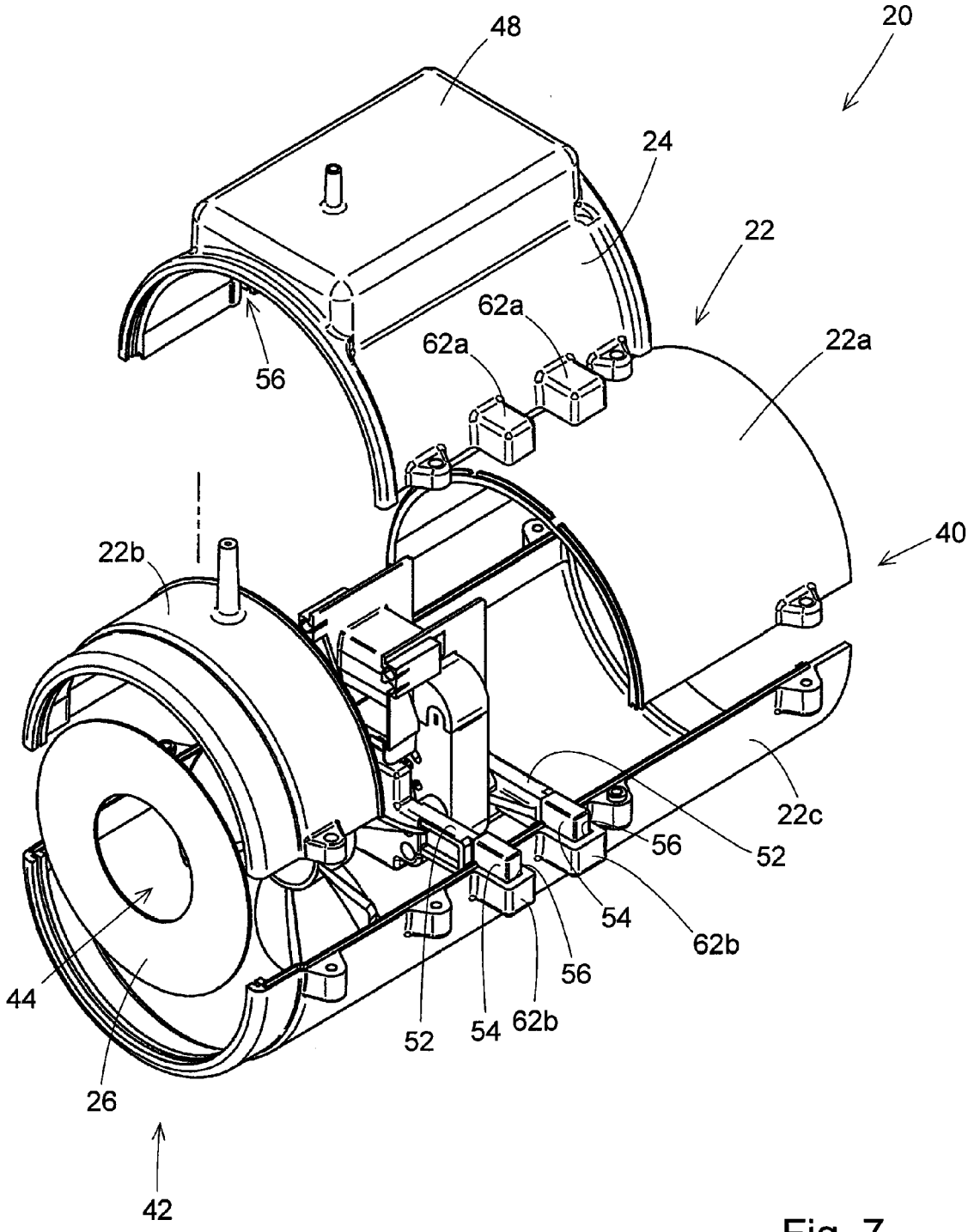
FIG. 7 is another partially exploded view of the blower housing of FIG. 1.
Figure 8:
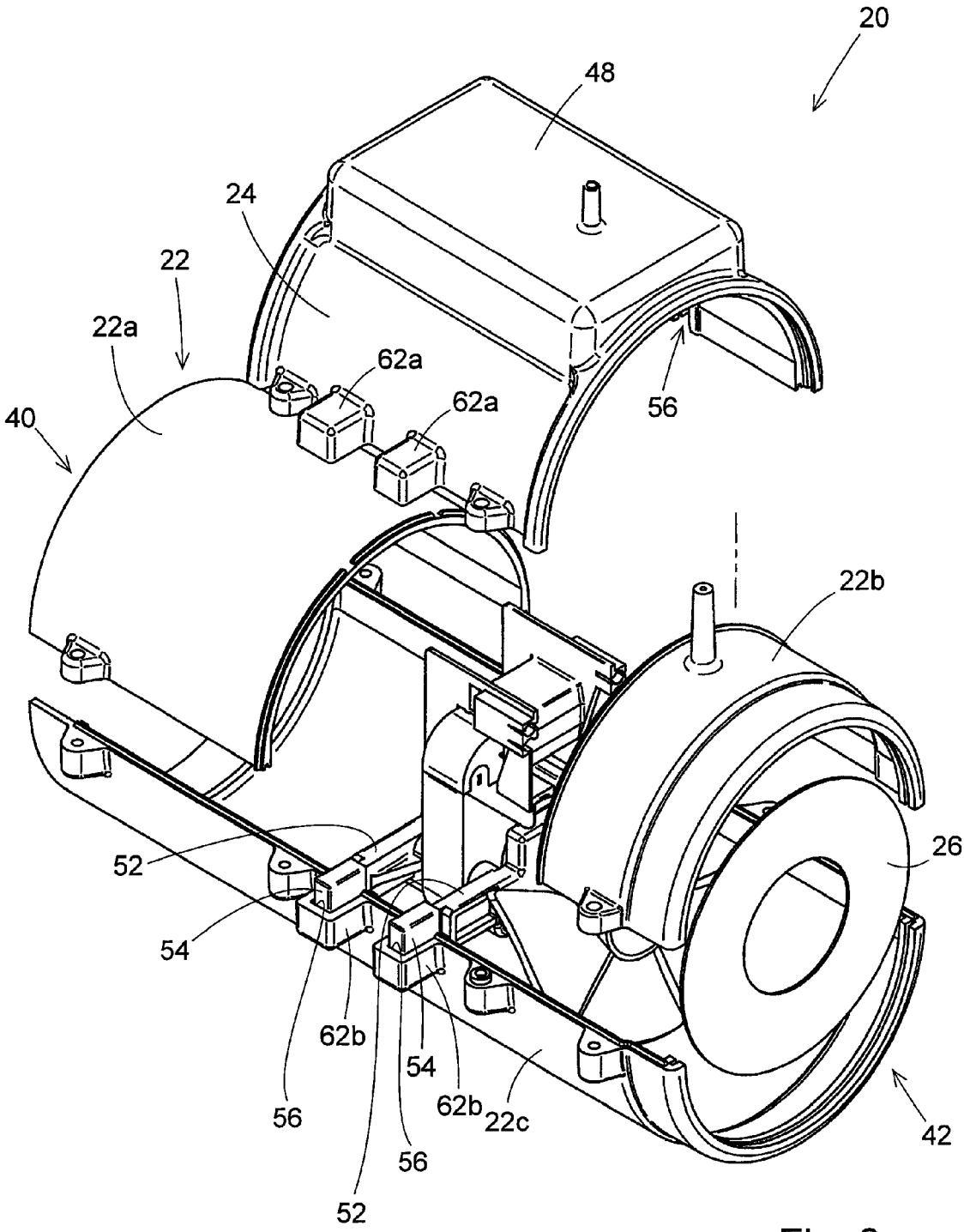
FIG. 8 is another partially exploded view of the blower housing of FIG. 1.

As shown in FIGS. 3 and 4, housing 22 includes an integral exhaust end 43 which terminates in a circular exhaust outlet 44 defined by exhaust outlet edge 46 to which a tube or other duct structure (not shown) may be attached in a suitable manner, such as with clamps or other fasteners.

As shown in FIGS. 5-8, blower 20 also includes motor and fan assembly 28 having fan motor 30 and fan 32 and a support structure 52. In operation, rotation of fan 32 by motor 30 draws air from an intake tube (not shown) through input end 40 of housing 22 and exhausts the air through exhaust end 43 of housing 22.

Cover 24 is removably attached to housing member 22*c* via fasteners 60 and mounting lugs 58, as described above, and generally provides a removable cover for motor and fan assembly 28. Cover 24 includes semicircular grooves or recesses 57 (FIG. 5) which are shaped to mate with protrusions or ridges 55 (FIG. 5) on housing members 22*a*, 22*b*, thereby effectively sealing the connection between cover 24 and housing members 22*a*, 22*b*. Cover 24 includes pocket lugs 62*a* which define portions of pockets 56 and housing member 22*c* includes pocket lugs 62*b* which define portions of pockets 56, such that when housing member 22*c* and cover 24 are assembled, pocket lugs 62*a*, 62*b* together define pockets 56.

Fan motor 30 includes extended bearing straps or support structures 52 extending laterally from motor 30 which have elastomeric boots 54 disposed thereon. Fan motor 30 is positioned in housing member 22*c* by positioning elastomeric boots 54 of straps 52 of fan motor 30 in pocket lugs 62*b*. Pocket lugs 62*a* in cover 24 provide a complementary shape to securely and substantially enclose boots 54 in pockets 56 between housing member 22*c* and cover 24. It can be seen in the drawing figures that with the support structure 52 extending into the pockets 56 of the pocket lugs 62 of the housing 22 and cover 24, that portion 5 of the pocket lugs 62 engage against laterally opposite sides of the motor and fan assembly 28 and portions of the pocket lugs 62 engage against longitudinally opposite sides of the motor and fan assembly 28. The positioning of the boots 54 and the opposite ends of the support structure 52 in the pockets 56 holds the fan and motor assembly 28 in a laterally fixed position and a longitudinally fixed position relative to the housing 22 and cover 24 of the blower 20.

Therefore, when cover 24 is attached to housing member 22*c*, pockets 56 securely hold and capture boots 54 and straps 52 of fan motor 30, thereby securing motor and fan assembly 28 in a laterally fixed and longitudinally fixed position within blower 20. Advantageously, no additional fasteners or brackets, for example metal brackets, are required to attach motor and fan assembly 28 to either housing member 22*c* and/or cover 24. Moreover, boots 54 advantageously dampen any vibration produced by motor and fan assembly 28 in operation to provide a quieter operation of blower 20.

Figure 9:
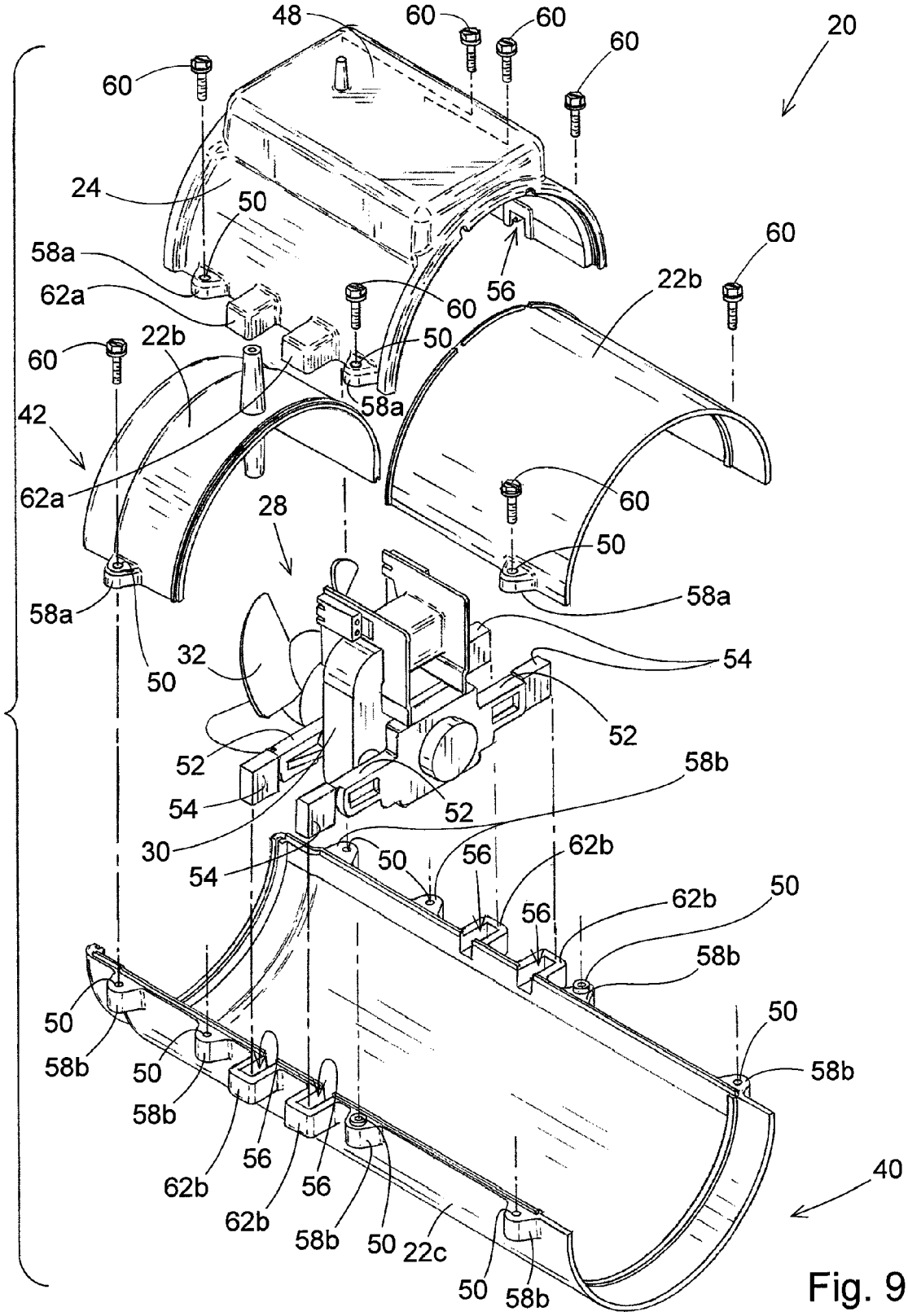
FIG. 9 is a partially exploded view of the blower housing of FIG. 1, further illustrating the motor and fan assembly exploded away from the blower housing.

In use and referring to FIG. 9, for maintenance and/or removal of motor and fan assembly 28, cover 24 is removed from housing 22 via removal of at least fasteners 60 from engagement with mounting lugs 58*b* of housing member 22*c*, a technician or other person may easily remove motor and fan assembly 28 from housing member 22*c* by lifting straps 52 out of engagement with pockets 56 and removing motor and fan assembly 28 from blower 20 with relative ease. No fasteners hold the motor and fan assembly 28 in the blower 20 and therefore it is not necessary to remove fasteners from the motor and fan assembly 28 before removing the assembly from the blower. Thus, maintenance, repair, and/or replacement of motor and fan assembly 28 are advantageously easily accomplished. Furthermore, the technician may also easily access motor and fan assembly 28 after removal of cover 24 without removing motor and fan assembly 28 from the remainder of blower 20. In this manner, motor and fan assembly 28 may be repaired and/or maintained while still positioned within housing member 22*c*, after which cover 24 may be reattached to housing member 22*c* to enclose motor and fan assembly 28.

To reattach cover 24 after repositioning and/or repair of a motor and fan assembly 28, mounting lugs 58*a* of cover 24 are aligned with mounting lugs 58*b* of housing member 22*c* and fasteners 60 are inserted through openings 50 in mounting lugs 58*a*, 58*b*. Motor and fan assembly 28 is captured between cover 24 and housing member 22*c*. Motor and fan assembly 28 is not fixedly attached to either cover 24 or housing member 22*c* and no separate bracket or fastener is required to hold motor and fan assembly 28, thereby enhancing operation of motor and fan assembly 28 and providing easy removal of motor and fan assembly 28. Rather, motor and fan assembly 28 is sandwiched between cover 24 and housing member 22*c*, thereby advantageously capturing motor and fan assembly 28 therebetween. Optionally, a gasket or other seal (not shown) formed of a suitable resilient material, such as Neoprene or EPDM rubber, for example, may be provided between cover 24 and housing members 22*a*, 22*b*, 22*c* to provide an air seal therebetween.

Advantageously, blower 20 of the present invention is simple to build. Also, motor and fan assembly 28 requires no separate fasteners and/or brackets to attach motor 30 to blower 20. The lack of any separate metal brackets to attach motor 30 advantageously affects the performance of motor 30. Furthermore, motor and fan assembly 28 is easily removed for cleaning, repair, maintenance, and/or replacement. Moreover, no tools are required to remove motor and fan assembly 28 from blower 20 because a technician may simply lift motor and fan assembly 28 from blower 20.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A combustion air supply blower, comprising:

a housing formed of a plurality of removably attachable members and having a lateral width and a longitudinal length;

a cover removably attached to the housing and having a lateral width and a longitudinal length, wherein the longitudinal length of the cover is less than the longitudinal length of the housing;

a motor and fan assembly; and a plurality of pocket lugs that engage with and secure the motor and fan assembly at a fixed position relative to the housing and the cover, the motor and fan assembly mounted within the housing and accessible by removal of the cover so that the motor and fan assembly can be serviced without removal of the motor and fan assembly from the housing with the motor and the fan assembly being substantially located below the longitudinal length and the lateral width of the cover.

2. The combustion air supply blower of claim 1, further comprising:

the motor and fan assembly being mounted in the blower solely by the cover being removably attached to the housing, whereby the motor and fan assembly is removable from the blower solely by detaching the cover from the housing, removing the cover from the housing and removing the motor and fan assembly from the housing.

3. The combustion air supply blower of claim 2, further comprising:

the housing and the cover removably attached to the housing defining a hollow interior bore of the blower; and the motor and fan assembly being secured by the cover removably attached to the housing in the interior bore of the blower.

4. The combustion air supply blower of claim 1, further comprising:

the housing and cover engaging against opposite sides of the motor and fan assembly with the cover attached to the housing and thereby securing the motor and fan assembly in the blower.

5. The combustion air supply blower of claim 1, further comprising:

the housing having a semi-circular cross section;

the cover having a semi-circular cross section; and the cover removably attached to the housing defining a cylindrical tube with an interior bore containing the motor and fan assembly.

6. The combustion air supply blower of claim 1, further comprising:

the pocket lugs of the housing and the cover having hollow pockets that receive portions of the motor and fan assembly.

7. The combustion air supply blower of claim 6, further comprising:

the motor and fan assembly having a support structure, a motor secured to the support structure, and a fan mounted on the motor for rotation of the fan on operation of the motor, the support structure being received in the hollow pockets of the pocket lugs and thereby mounting the motor and fan assembly in the blower.

8. The combustion air supply blower of claim 1, further comprising:

elastic boots mounting the motor and fan assembly in the blower whereby the elastic boots dampen vibration of the motor and fan assembly transmitted to the blower.

9. A combustion air supply blower comprising:

a housing having a lateral width and a longitudinal length and formed of a plurality of removably attachable members;

a cover having a lateral width and a longitudinal length, the cover being removably attached to the housing whereby the cover and the housing define a hollow interior bore of the blower, wherein the longitudinal length of the cover is less than the longitudinal length of the housing;

at least a pair of pocket lugs that are accessible in the interior bore of the blower; and a motor and fan assembly mounted in the blower interior bore between the housing and the cover, the pair of pocket lugs engaging with the motor and fan assembly, the pair of pocket lugs solely holding the motor and fan assembly in a laterally fixed position and a longitudinally fixed position relative to the housing and the cover, wherein the motor and fan assembly can be serviced without removal of the motor and fan assembly from the housing by removal of the with the motor and the fan assembly being substantially located below the longitudinal length and the lateral width of the cover.

10. The combustion air supply blower of claim 8, further comprising:

a pair of pocket lugs engaging against longitudinally opposite sides of the motor and fan assembly and thereby holding the motor and fan assembly in a longitudinally fixed position relative to the housing and the cover.

11. The combustion air supply blower of claim 9, further comprising:

the pair of pocket lugs engaging against laterally opposite sides of the motor and fan assembly and thereby laterally fixing the motor and fan assembly relative to the housing and the cover.

12. The combustion air supply blower of claim 9, further comprising:

the pair of pocket lugs being on the housing and the cover.

13. The combustion air supply blower of claim 9, further comprising:

the cover removably attached to the housing solely mounting the motor and fan assembly in the blower whereby the motor and fan assembly is removable from the blower solely by detaching the cover from the housing, removing the cover from the housing and removing the motor and fan assembly from the housing.

14. The combustion air supply blower of claim 9, further comprising:

each of the pocket lugs having a hollow pocket in the pocket lug; and, the motor and fan assembly being received in the pocket of each of the pocket lugs whereby the pocket lugs engage against laterally opposite sides of the motor and fan assembly and longitudinally opposite sides of the motor and fan assembly.

15. The combustion air supply blower of claim 14, further comprising:

elastic boots on the motor and fan assembly that are received in the hollow pockets of the pair of pocket lugs, the elastic boots thereby dampening vibration of the motor and fan assembly that is transmitted to the blower.

16. A combustion air supply blower comprising:

a housing formed of a plurality of removably attachable housing members, each housing member of the plurality of housing members having a wall with a lateral width having a semi-circular configuration and a longitudinal length, at least one housing member of the plurality of housing members having at least one pocket lug that project laterally outwardly from opposite sides of the housing member wall with each pocket lug having a hollow pocket inside the pocket lug, and at least one housing member of the plurality of housing members having at least one mounting lug that project laterally outwardly from opposite sides of the housing member wall;

a cover having a lateral width with a semi-circular configuration and a longitudinal length, the cover having at least a pair of pocket lugs that project laterally outwardly from opposite sides of the cover with each pocket lug having a hollow pocket inside the pocket lug, and the cover having at least a pair of mounting lugs that project laterally outwardly from opposite sides of the cover, the cover being removably attachable to the housing by separate fasteners that connect the mounting lugs of the cover to the mounting lugs of the housing, the cover removably attached to the housing defining a cylindrical interior bore of the blower that extends longitudinally between the housing and the cover, wherein the longitudinal length of the cover is less than the longitudinal length of the housing; and a motor and fan assembly between the housing member and the cover and inside the longitudinal interior bore defined by the housing and the cover, the motor and fan assembly having a support structure with laterally opposite ends that extend into the pockets of pocket lugs on laterally opposite sides of the housing and cover, whereby the motor and fan assembly is securely supported in the interior bore of the blower without fasteners, wherein the motor and fan assembly can be serviced without removal of the motor and fan assembly from the housing by removal of the with the motor and the fan assembly being substantially located below the longitudinal length and the lateral width of the cover.

17. The combustion air supply blower of claim 16, further comprising:

the motor and fan support structure engaging in the pockets of the pocket lugs solely securing the motor and fan assembly laterally and longitudinally relative to the housing and the cover.

18. The combustion air supply blower of claim 16, further comprising:

elastic boots on the support structure, the elastic boots being secured in the pockets of the pocket lugs and thereby dampening vibration of the motor and fan assembly from the housing and cover.

* * * * *